US010945543B2

(12) United States Patent
Brooks

(10) Patent No.: US 10,945,543 B2
(45) Date of Patent: Mar. 16, 2021

(54) OBJECT FOR FACILITATING SPOONING AND A METHOD OF USING THE SAME

(71) Applicant: Christopher Marcus Brooks, Cleveland, OH (US)

(72) Inventor: Christopher Marcus Brooks, Cleveland, OH (US)

( * ) Notice: Subject to any disclaimer, the term of this patent is extended or adjusted under 35 U.S.C. 154(b) by 212 days.

(21) Appl. No.: 16/260,551

(22) Filed: Jan. 29, 2019

(65) Prior Publication Data

US 2020/0237121 A1 Jul. 30, 2020

(51) Int. Cl.
*A47G 9/10* (2006.01)
*A47G 9/02* (2006.01)
*A47C 20/02* (2006.01)

(52) U.S. Cl.
CPC ..... *A47G 9/10* (2013.01); *A47G 9/0253* (2013.01); *A47G 9/1027* (2013.01); *A47C 20/023* (2013.01)

(58) Field of Classification Search
CPC ..... A47C 20/023; A47G 9/10; A47G 9/1009; A47G 9/1027; A47G 9/1036; A47G 9/1045; A47G 9/1054; A47G 9/1063; A47G 9/109; A47G 9/0253; A47G 9/0238; A47G 2009/1018
USPC ..... D6/595–601
See application file for complete search history.

(56) References Cited

U.S. PATENT DOCUMENTS 5,604,944 A * 2/1997 Meade ..... A47G 9/1009 5/636
8,276,227 B2 * 10/2012 Pileggi ..... A47G 9/1081 5/640

* cited by examiner

*Primary Examiner* — Eric J Kurilla
*Assistant Examiner* — Amanda L Bailey

(57) ABSTRACT

A spooning pillow system and a method of using the same is provided. The spooning pillow system and method embodies a spooning pillow having an arm cavity adapted for a rearward individual in a spooning configuration may comfortably position their underlying arm therein. The spooning pillow system may also include a spooning pillowcase with connector flaps interconnecting the spooning pillowcase with auxiliary pillowcases encasing convention pillows so that the encased conventional pillows are movably attached to the spooning pillowcase. Thereby the encased convention pillows may be moved between an uncovered condition and a covered condition covering the arm cavity so that the spooning individuals can rest their heads on the conventional pillows.

7 Claims, 4 Drawing Sheets

OBJECT FOR FACILITATING SPOONING AND A METHOD OF USING THE SAME

BACKGROUND OF THE INVENTION

The present invention relates to pillows and, more particularly, to a pillow dimensioned and adapted to support the arm placement of the rearward individual in a spooning configuration.

Many people find that the fetal position is a natural and comfortable sleeping position. Often, two people wanting to share a sense of intimacy and a sense of a physical bond will both lie in the fetal position, side by side, facing the same direction and nested closely together "spooning". The spooning position often gives two people the desired sense of emotional comfort. For the individual in the rearward spooning position, however, spooning can at times be physically uncomfortable because of their arm they are lying on. That underlying arm needs to be either under the forward individual or extending awkwardly away therefrom. As a result, that underlying arm can be uncomfortably pinned below the other person or positioned so not to be pinned there under. In short, the spooning configuration can be very nice for the forward individual but can be uncomfortable for the rearward individual. Furthermore, the forward individual can also be disturbed during the process of the reward individual repositioning their underlying arm As can be seen, there is a need for a spooning pillow for supporting the arm placement of the rearward individual who is in a spooning configuration. The spooning pillow embodied by the present invention is dimensioned and adapted to reduce such discomfort of the rearward individual by providing a comfortable space for their underlying arm, and as a result helping improve the quality of rest for the forward individual, who no longer needs to be disturbed since said underlying arm does not need to be removed from a pinned condition under them.

In short, the present invention prevents the weight of a user's partner's head/body from pinning the user's underlying arm, reducing the discomfort of spooning for the user, as well as promoting better sleep for their partner as the user can comfortable position their underlying arm without disturbing their partner.

SUMMARY OF THE INVENTION

In one aspect of the present invention, a spooning pillow includes the following: an elongated pillow body having an upper surface and lower surface defining a body length, a body width, and a body depth of the elongated body; an arm cavity centrally extending along a longitudinal axis of the elongated body; and the arm cavity defined by a concave void having a void width and a void depth, wherein the void depth is approximately half of the body depth, wherein the void width is approximately half of the body width, wherein concave void is arcuate in shape, or wherein the body length is two to five times that of the body width.

In another aspect of the present invention, a spooning pillowcase, includes the following: an elongated body case defining an enclosure dimensioned to slidably receive an entirety of a spooning pillow; the body case having a longitudinal edge; one or more connection flap depending from the longitudinal edge; and each connection flap terminating at an auxiliary pillowcase, the auxiliary pillowcase dimensioned to slidably receive an entirety of a conventional bed pillow, wherein each auxiliary pillowcase is movable between an uncovered condition and a covered condition overlaying an upper surface of the spooning pillow; and further including a detachable fastener along one end to removably seal the enclosure, and a conventional bed pillow encased in each auxiliary pillowcase.

In yet another aspect of the present invention, a spooning pillow system, includes the above-mentioned spooning pillow and the above-mentioned spooning pillowcase, wherein said spooning pillow is encased in said enclosure, and further including a conventional bed pillow encased in each auxiliary pillowcase.

In yet another aspect of the present invention, a method of a forward individual and a rearward individual forming a spooning configuration wherein an underlying arm of the rearward individual is generally perpendicularly extended but not contacting the forward individual, includes providing the above-mentioned spooning pillow system, sliding said underlying arm in a portion of the arm cavity; and moving to the covered condition the one or more auxiliary pillowcase associated with said portion of portion of the arm cavity.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a spooning pillow system and a method of using the same. The spooning pillow system and method embodies a spooning pillow having an arm cavity for the rearward individual in a spooning configuration may comfortably position their underlying arm therein. The spooning pillow system may also include a spooning pillowcase with connector flaps interconnecting the spooning pillowcase with auxiliary pillowcases encasing convention pillows so that the encased conventional pillows are movably attached to the spooning pillowcase. Thereby the encased convention pillows may be moved between an uncovered condition and a covered condition covering the arm cavity so that the spooning individuals can rest their heads on the conventional pillows.

Referring to FIGS. 1 through 6, the present invention may include a spooning pillow 10 or 40. The spooning pillow 10 or 40 may be inflatable or stuffed; in other words, the spooning pillow 10 or 40 provides an inner chamber or enclosure filled with a substance 36 (e.g., air or stuffing, respectively, etc.). If inflatable, the spooning pillow 10 provides an inflation valve 14.

Figure 3:
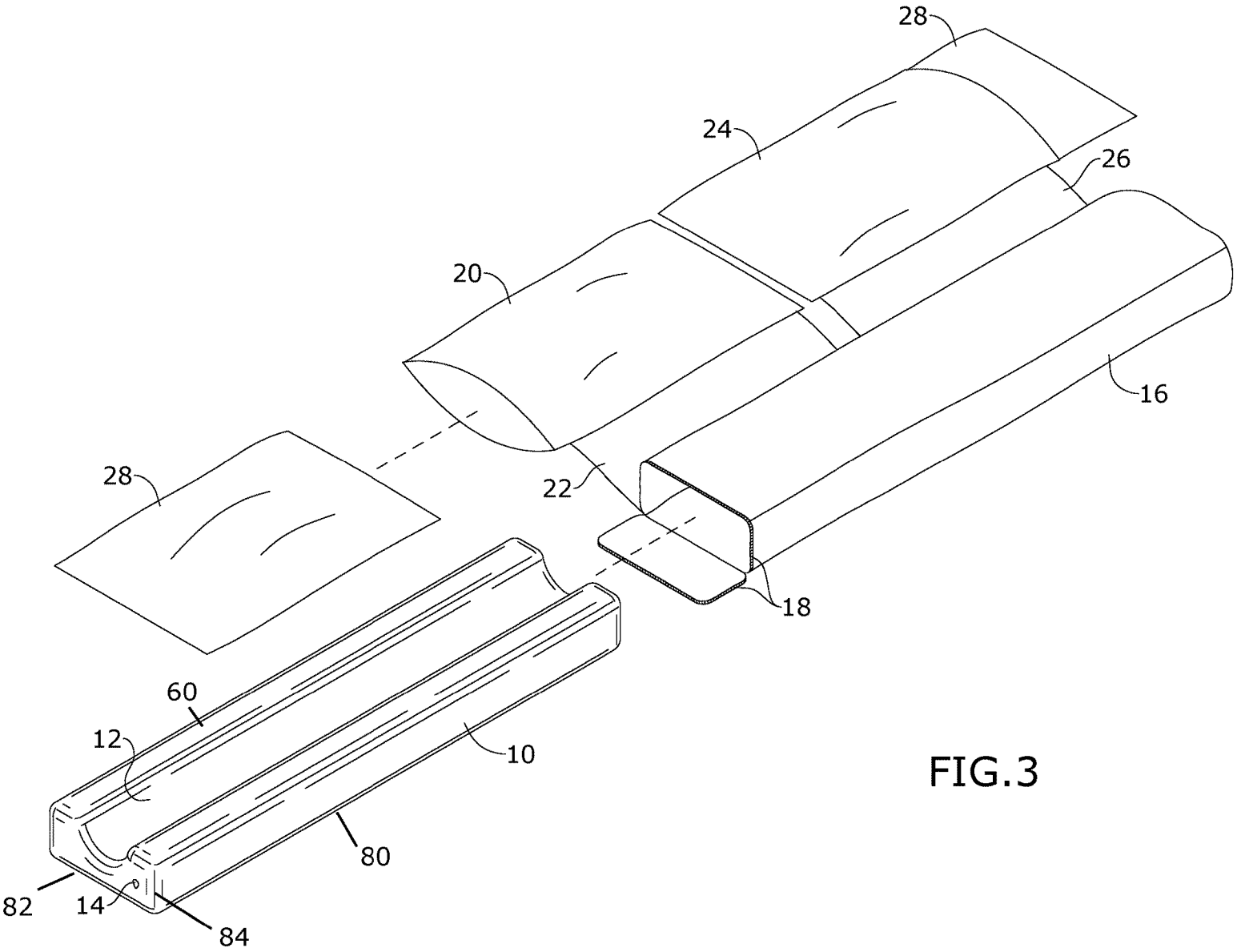
FIG. 3 is an exploded perspective view of an exemplary embodiment of the present invention, with one pillow 28 fully removed from auxiliary pillowcase 20 and another pillow 29 only partially removed from auxiliary pillowcase 24.

The spooning pillow 10 or 40 may be generally elongating—i.e., having a length 80 two to five times its width 82. The length may be approximately 24 to 48 inches for the spooning pillow 40 and 10, respectively. The width 82 may be approximately 14 inches. The spooning pillow 10 or 40 has an upper portion 60 and a lower portion 70, that define a depth 84 of the spooning pillow 10, as illustrated in FIG. 3, but understood to be applicable to spooning pillow 40. In certain embodiments, the depth 84 may be approximately six inches.

Figure 1:
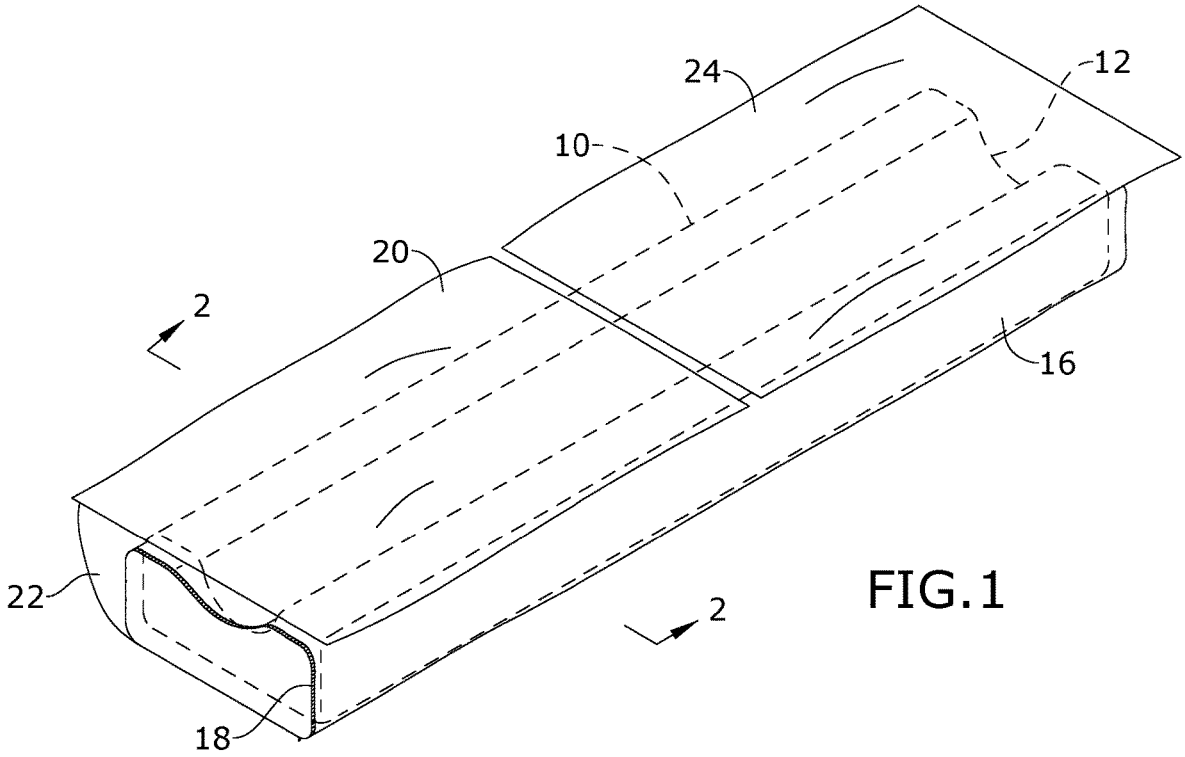
FIG. 1 is a perspective view of an exemplary embodiment of the present invention.
Figure 2:
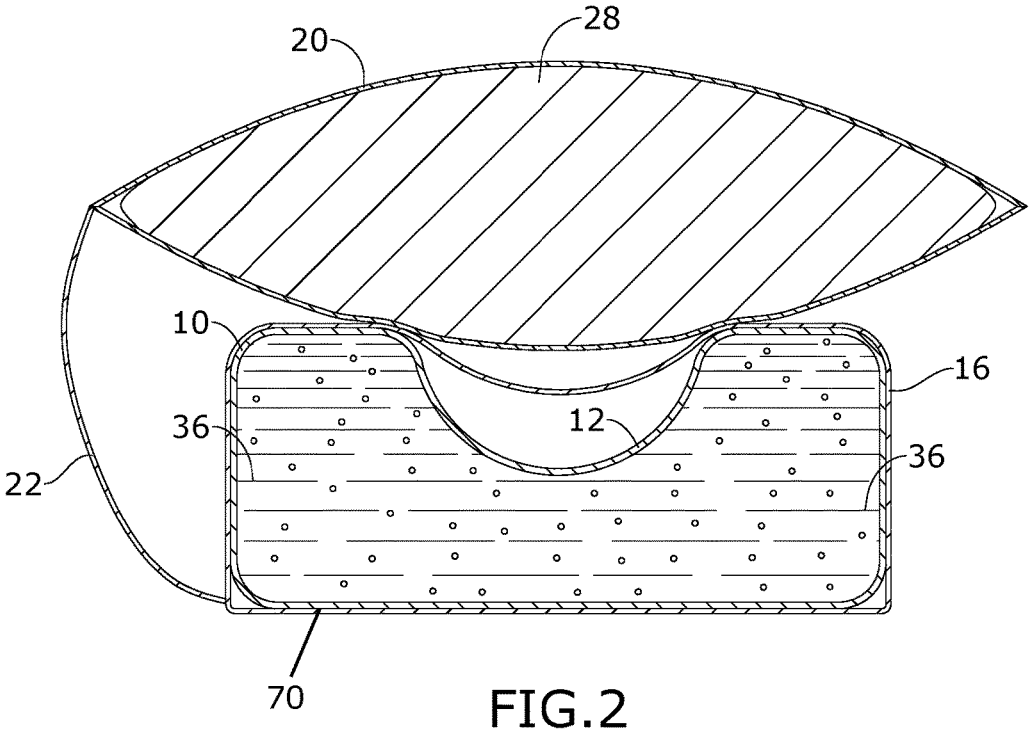
FIG. 2 is a section view of an exemplary embodiment of the present invention, taken along line 2-2 of FIG. 1.

An arcuate arm cavity 12 or 42 is provided along the upper surface 60. The arm cavity 12 or 42 may be defined a semi-circular curvature having a diameter that is approximately half of the width 82 and approximately half of the depth 84, wherein the arm cavity 12 or 42 is centrically disposed as it extends along the longitudinal axis of the upper surface 60, as illustrated in FIG. 2. In certain embodiments, the arm cavity 12 or 42 width may be approximately six inches and its depth approximately five inches.

Figure 4:
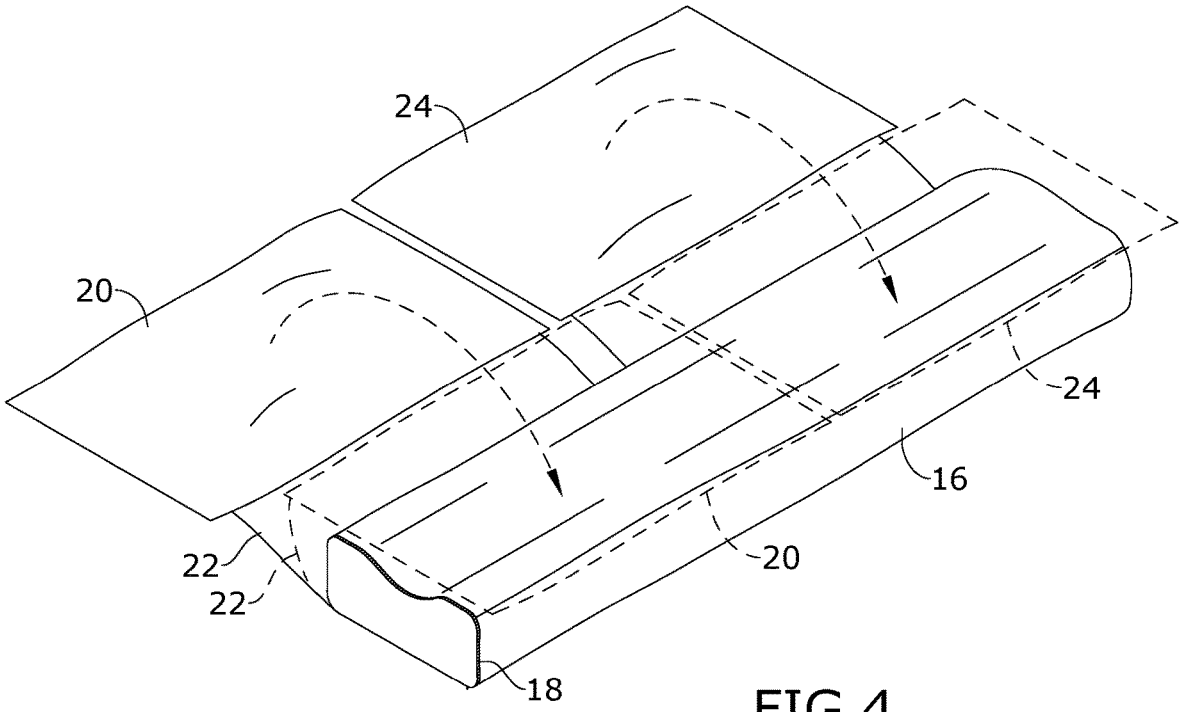
FIG. 4 is a perspective view of an exemplary embodiment of the present invention, illustrating the movability from an uncovered condition to a covered condition, as enabled by connection flap 20.
Figure 6:
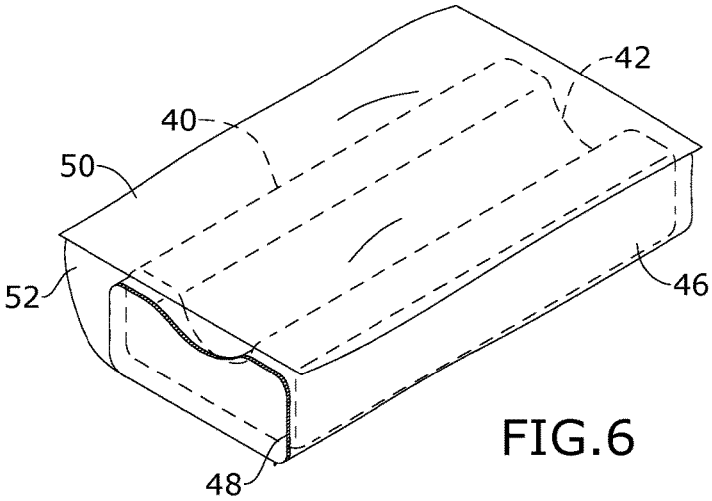
FIG. 6 is a perspective view of an exemplary embodiment of the present invention, 40 which is not as elongated as the embodiment 10 shown in FIG. 1.

The present invention may include a spooning pillowcase 16 or 46 dimensioned to slidably receive the entirety of the spooning pillow 10 or 40, respectively, much like a conventional pillowcase. Moreover, the spooning pillowcase 16 or 46 may provide detachable fasteners 18 or 48, such as zippers, along one end for closing off the spooning pillowcase 16 or 46 around the fully received spooning pillow 10 or 40, respectively. Unlike conventional pillowcases, the spooning pillowcase 16 or 46 may provide one or more connection flaps (e.g., first and second) 22 and 26 or 52 depending from a longitudinal edge of the spooning pillowcase 16 or 46, as illustrated in FIGS. 2 and 6, respectively. Each connection flap 22, 26, and 52 extends to an auxiliary pillowcase 20, 24, and 50, respectively. Each connection flap 22, 26, and 52 may extend from the lower longitudinal edge of the spooning pillowcase 16 or 46 to a longitudinal edge of the associated auxiliary pillowcase 20, 24 and 50, as illustrated in FIG. 2. Each connection flap 22, 26, and 52 enables the auxiliary pillowcases 20, 24, and 50 to be movable between an uncovered condition (as illustrated in FIG. 3) to a covered condition (as illustrated in FIG. 4) covering the respective arm cavity 12 or 42. Each auxiliary pillowcase 20, 24 and 50 is dimensioned and adapted to slidably receive a standard pillow 28, be those pillows 28 queen-sized or larger or smaller.

A method of using the present invention may include the following. The spooning pillow 10 or 40 and spooning pillowcase 16 or 46 disclosed above may be provided. A person would use conventional pillows 28 they already have and insert them into the auxiliary pillowcase 20, 24 or 50 of the spooning pillowcase 16 or 46. The user would either make sure the spooning pillow 10 or 40 was properly inflated or filled, and then slide it into the associated spooning pillowcase 16 or 46, and most likely utilize the fasteners 18 or 48 to close off the spooning pillowcase 16 or 46. Then the user could then move the auxiliary pillowcase 20, 24, or 50 to the cover condition, to ready the present invention for use and so provide a clean, "made" appearance to go along with a properly made bed.

Figure 5:
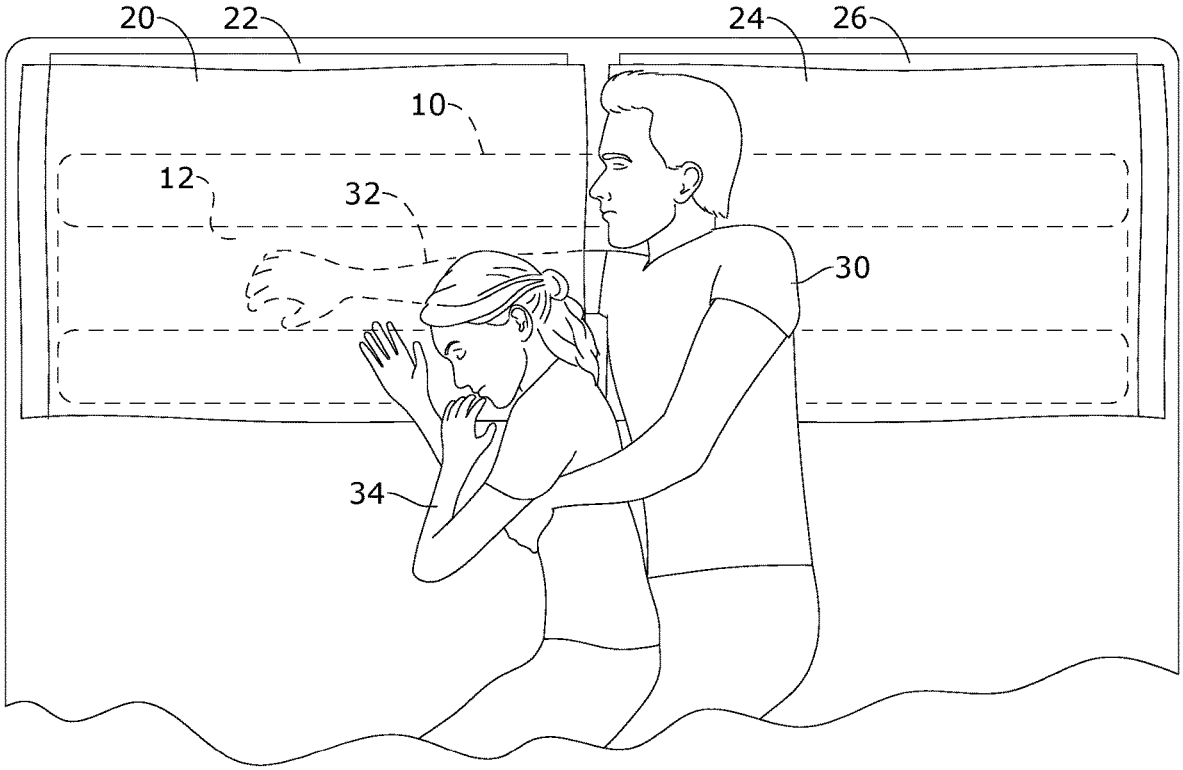
FIG. 5 is a top view of an exemplary embodiment of the present invention, shown in use by first and second individuals 34 and 30 in a spooning configuration.

A user would place it on their bed like a normal pillow and lie down. Once the rearward individual 30 is in a spooning configuration with a forward individual 34, then the rearward individual 30 can slide their underlying arm 32 into the arm cavity 12 or 42, as illustrated in FIG. 5. This way, the forward individual 34 will not be disturbed when the rearward individual 30 slides their underlying arm 32 from the arm cavity 12 or 42, for example when the rearward individual 30 decides to get up for whatever reason. With the auxiliary pillowcase 20 in the closed condition, the forward individual 34 may comfortable rest their head on the conventional pillow 28 and not the underlying arm 32 and/or arm cavity 12 or 42. The rearward individual 30 may also have their auxiliary pillowcase 24, they too may rest their head on their conventional pillow 28 so that the (unused) arm cavity 12 or 42 does not both their sleep.

It should be understood, of course, that the foregoing relates to exemplary embodiments of the invention and that modifications may be made without departing from the spirit and scope of the invention as set forth in the following claims.

What is claimed is:

1. A spooning pillow system, comprising:

a spooning pillow comprising an elongated pillow body having an upper surface and lower surface defining a body length, a body width, and a body depth of the elongated body; an arm cavity centrally extending along a longitudinal axis of the elongated body; the arm cavity defined by a concave void having a void width and a void depth, wherein the void depth is approximately half of the body depth and when in use, an apex of the concave void faces away from the user; and a spooning pillowcase, comprising: an elongated body case defining an enclosure dimensioned to slidably receive an entirety of the spooning pillow; the body case having a longitudinal edge; one or more connection flaps depending from the longitudinal edge; and each connection flap terminating at a longitudinal peripheral edge of an auxiliary pillowcase, the auxiliary pillowcase dimensioned to slidably receive an entirety of a conventional bed pillow, wherein each auxiliary pillowcase is movable between an uncovered condition and a covered condition overlaying an upper surface and the arm cavity of the spooning pillow, wherein said elongated pillow body is encased in said enclosure.

2. The spooning pillow system of claim 1, wherein the void width is approximately half of the body width.

3. The spooning pillow system of claim 1, wherein the concave void is arcuate in shape.

4. The spooning pillow system of claim 1, wherein the body length is approximately five times that of the body width.

5. The spooning pillow system of claim 1, wherein the body length is approximately twice that of the body width.

6. The spooning pillow system of claim 1, further comprising a detachable fastener along one end of the pillowcase to removably seal the enclosure.

7. A method of a forward individual and a rearward individual forming a spooning configuration wherein an underlying arm of the rearward individual is generally perpendicularly extended relative to a torso of the rearward individual but not contacting the forward individual, comprising: providing the spooning pillow system of claim 1; sliding said underlying arm in a portion of the arm cavity;

and moving to the covered condition the one or more auxiliary pillowcase associated with said portion of the arm cavity.

* * * * *